US006425813B1

(12) United States Patent
Ernst

(10) Patent No.: US 6,425,813 B1
(45) Date of Patent: Jul. 30, 2002

(54) ROTARY FLOOR SANDER

(76) Inventor: Edwin C. Ernst, 1095 Strathy Ave., Unit 9, Mississauga, Ontario (CA), L5E 2K1

( * ) Notice: Subject to any disclaimer, the term of this patent is extended or adjusted under 35 U.S.C. 154(b) by 39 days.

(21) Appl. No.: 09/677,520

(22) Filed: Sep. 30, 2000

(51) Int. Cl.[7] ..... B24B 23/00
(52) U.S. Cl. ..... 451/350; 451/355
(58) Field of Search ..... 451/350, 352, 451/355, 356, 317, 353

(56) References Cited

U.S. PATENT DOCUMENTS 1,901,681 A * 3/1933 Vicenzi ..... 451/350
1,920,364 A * 8/1933 Degan ..... 451/350
4,225,998 A * 10/1980 Thielen ..... 451/517
4,358,868 A * 11/1982 Cook, Jr. ..... 451/353
4,845,798 A * 7/1989 Genovese ..... 451/353
5,287,660 A * 2/1994 Bellati et al. ..... 451/352
5,403,229 A * 4/1995 Seli ..... 451/352
5,416,943 A * 5/1995 Weltikol et al. ..... 451/353
5,454,751 A * 10/1995 Wiand ..... 451/353
5,575,710 A * 11/1996 Kramerq ..... 451/355
5,674,120 A * 10/1997 Legatt et al. ..... 451/353
5,855,505 A * 1/1999 Letts ..... 451/352
6,238,277 B1 * 5/2001 Duncan et al. ..... 451/271

* cited by examiner

*Primary Examiner*—Joseph J. Hail, III
*Assistant Examiner*—Hadi Shakeri
(74) *Attorney, Agent, or Firm*—Patrick J. Hofbauer

(57) ABSTRACT

A machine for sanding a floor for use with sandpaper having a smooth side and an abrasive side is disclosed and comprises a platform having a rearward end and a forward end, wheels mounted on the platform to support the rearward end for rolling movement, a sanding head, a motor and a handle. The sanding head defines a sanding face and is mounted on the platform for rotation about a vertical axis with the sanding face oriented normal to the vertical axis. The motor is mounted on the platform for driving said rotation. The handle is rigidly mounted to the platform, adjacent the rearward end, and extends substantially upwardly and rearwardly. An attachment means is also provided for selectively, releasably attaching said sandpaper to the sanding head, with the smooth side in underlying contactable relation to the sanding face and the abrasive side in contactable relation to the floor.

34 Claims, 15 Drawing Sheets

ROTARY FLOOR SANDER

FIELD OF THE INVENTION

The present invention relates to the field of floor sanders, and more particularly, relates to a rotary floor sander for use in sanding or finishing floors.

BACKGROUND OF THE INVENTION

It is desirable in modern construction practice that wooden floors be finished to a relatively smooth, flat surface. Moreover, it is known in the prior art to employ sanding devices to mechanically assist in such efforts. For efficient operation, such devices typically utilize disposable abrasive media, i.e. abrasive-coated paper or fabric, in belt, disc or sheet form.

An example of a prior art sanding device of this general type which utilizes disposable abrasive media in belt form is shown in U.S. Pat. No. 5,575,710 (Kramer), issued Nov. 19, 1996. This type of sanding device is known to be relatively reliable in operation, and to be relatively effective in material removal. However, this type of sanding device suffers in that, in order to avoid undulations in the floor surface, operators are required to exercise significant skill and dexterity. Further, abrasive belts are typically fairly expensive to purchase. As well, this type of sanding device is unable to effectively sand close up to walls or other protrusions.

An example of a prior art sanding device which utilizes disposable abrasive media in disc form is shown in U.S. Pat. No. 5,890,954 (Barous), issued Apr. 6, 1999. This general type of sanding device is known to be relatively reliable in operation, and to be effective in material removal. Further, this type of sanding device is known to overcome the shortcomings inherent in belt-type sanders, in that sanding can be effected relatively close to walls or other protrusions, and moreover, undulations in the floor surface may be avoided by the exercise of relatively modest amounts of skill, concentration and dexterity. However, this type of sanding device suffers in that replacement of the abrasive discs, which are relatively expensive to purchase, is relatively cumbersome and time-consuming, and typically requires the operator to physically remove and replace, through the use of hand tools, a bolt which retains the abrasive disc in position. As well, this type of sanding device is intended for use by an operator in a kneeling or stooped position, and as such, it is unsuited for use in sanding large expanses of floor surface. Additionally, this type of sanding device is known to release significant quantities of dust into the surroundings, despite the vacuum system provided therewith.

An example of a prior art sanding device which utilizes disposable abrasive media in sheet form is shown in U.S. Pat. No. 3,638,362 (Stoll), issued Feb. 1, 1972. This type of sanding device is known to be relatively reliable in operation, and is known to overcome many of the shortcomings inherent in disc and belt sanders, in that undulations in the floor surface will, for practical purposes, result only from carelessness in operation, and moreover, replacement of the abrasive sheets, which are relatively inexpensive to purchase, is relatively quick and simple. As well, sanding may be effected close to walls and other protrusions. However, this type of sanding device, which relies upon vibratory or orbital action of the abrasive surface, is known to be relatively slow and ineffective in material removal, and as such, unsuited for use in sanding large expanses of floor surface.

SUMMARY OF THE INVENTION

It is an object of the present invention to overcome, inter alia, the shortcomings of the prior art by providing a floor sander that is reliable in operation; that does not demand unduly onerous levels of skill, dexterity or concentration from the operator to achieve a relatively smooth, flat finish; that utilizes inexpensive sheets of abrasive media; that enables abrasive exchange to be conveniently accomplished without the use of hand tools; which has practical utility in applications which require large expanses of floor surface to be sanded; which releases relatively modest amounts of dust into its surroundings in use; and which has practical utility in application wherein floor sanding operations must be effected close to walls or other protrusions.

These and other objects are addressed by the present invention, a rotary floor sander.

In accordance with a first aspect of the invention, the rotary floor sander is for use with one or more sheets of flexible sanding media each having a first portion, a second portion, a smooth side and an abrasive side, and comprises a platform. The platform has a rearward end and a forward end and defines a longitudinal axis extending between the rearward end and the forward end. Two or more wheels are mounted on the platform adjacent to the rearward end for rotation about a lateral axis extending substantially normal to said longitudinal axis. The wheels are operatively positioned upon the floor surface so as to support the rearward end of the platform for rolling movement substantially parallel to the longitudinal axis. A sanding head member is also provided. The sanding head member defines a substantially planar sanding face, and is mounted on the platform for rotation about a substantially vertical axis with the sanding face being oriented substantially normal to the substantially vertical axis and substantially parallel to the floor surface. A drive means is mounted on the platform for driving said rotation of the sanding head member about the substantially vertical axis. Additionally, an attachment means is provided for selectively, releasably attaching one or more sheets of said flexible sanding media to the sanding head member for rotation therewith, with the smooth side of each of said sheets in contactable relation to said sanding face and with the abrasive side of each of said sheets in contactable relation to said floor surface. A handle means is also provided, rigidly mounted to the platform, adjacent to the rearward end thereof, and oriented substantially upwardly and rearwardly.

According to another aspect of the invention, the rotary floor sander preferably comprises a positioning means for selective movement of each of the wheels between a fully raised position, whereat the rearward end of the platform is relatively proximal to the floor surface, and a fully lowered position, substantially downwardly disposed from the fully raised position, whereat the rearward end of the platform is relatively distal to the floor surface. The positioning means further provides for selective movement of each of said wheels between a rearward position, whereat said each wheel is relatively proximal to the rearward end of the platform, and a forward position, substantially longitudinally forwardly disposed from the rearward position, whereat said each wheel is relatively distal to the rearward end of the platform.

According to another aspect of the invention, the attachment means preferably comprises one or more elongate slots defined in the sanding face, each of the elongate slots being shaped and dimensioned for releasable extension therethrough of the first portion of a respective one of the sheets of flexible sanding media.

According to another aspect of the invention, each elongate slot is preferably aligned substantially tangentially to an arc of rotation defined by the substantially vertical axis.

According to other aspects of the invention, the rotary floor sander preferably further comprises a downwardly-depending housing member mounted on the platform and defining a downwardly-opening chamber, and a skirt member mounted on the housing member and defining a chamber extension contiguous with said chamber, said skirt member being mounted for movement substantially parallel to the substantially vertical axis between a lowered position, whereat the chamber and chamber extension collectively operatively enclose said sanding head member and said one or more sheets of flexible sanding media, and a raised position, substantially vertically upwardly disposed from the lowered position. A vacuum means is additionally provided, in operative fluid communication with said chamber.

According to one further aspect of an alternative embodiment of the present invention, the rotary floor sander is for use with one or more sheets of sanding media, each of said sheets having a smooth side and an abrasive side, and comprises a platform. The platform has a rearward end and a forward end and defines a longitudinal axis extending between the rearward end and the forward end. Two or more wheels are mounted on the platform adjacent to the rearward end for rotation about a lateral axis extending substantially normal to said longitudinal axis. The wheels are operatively positioned upon the floor surface so as to support the rearward end of the platform for rolling movement substantially parallel to the longitudinal axis. A sanding head member is also provided. The sanding head member defines a substantially planar sanding face, and is mounted on the platform for rotation about a substantially vertical axis with the sanding face being oriented substantially normal to the substantially vertical axis and substantially parallel to the floor surface. A drive means is mounted on the platform for driving said rotation of the sanding head member about the substantially vertical axis. Additionally, an attachment means is provided for selectively, releasably attaching one or more sheets of sanding media to the sanding head member for rotation therewith, with the smooth side of each of said sheets in contactable relation to said sanding face and with the abrasive side of each of said sheets in contactable relation to said floor surface. A handle means is also provided, rigidly mounted to the platform, adjacent to the rearward end thereof, and oriented substantially upwardly and rearwardly.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the rotary floor sander according to the present invention, as to its structure, organization, use and method of operation, together with further objectives and advantages thereof, will become more apparent upon consideration of the following detailed description and the appended claims with reference to the accompanying drawings, the latter of which is briefly described hereinbelow. It should be expressly understood, however, that the drawings are for the purpose of illustration and description only, and are not intended as a definition of the limits of the invention. In the accompanying drawings:

DETAILED DESCRIPTION OF A PREFERRED EMBODIMENT

Figure 1:
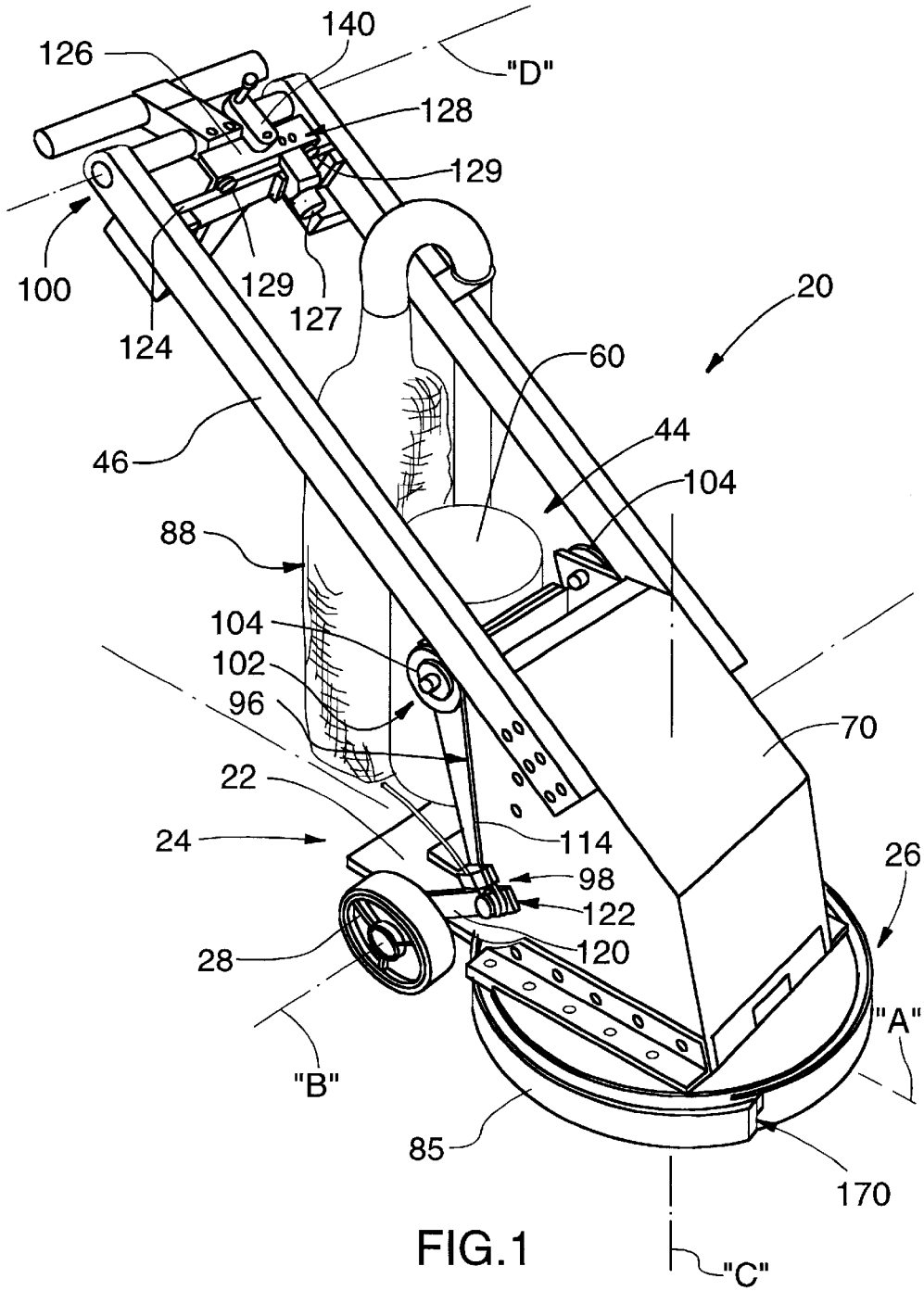
FIG. 1 is a perspective view of a preferred embodiment of the rotary floor sander according to the present invention.

With general reference to FIGS. 1 through 16 and 19 through 22, a preferred embodiment of the present invention is illustrated and is designated by general reference numeral 20. The precise manner of construction and operation of the preferred embodiment will be fully described in the following paragraphs. However, for greater clarity, the main components and general manner of operation of the preferred embodiment, and the cooperating environment within which it is intended to be used, will be firstly described.

Figure 2:
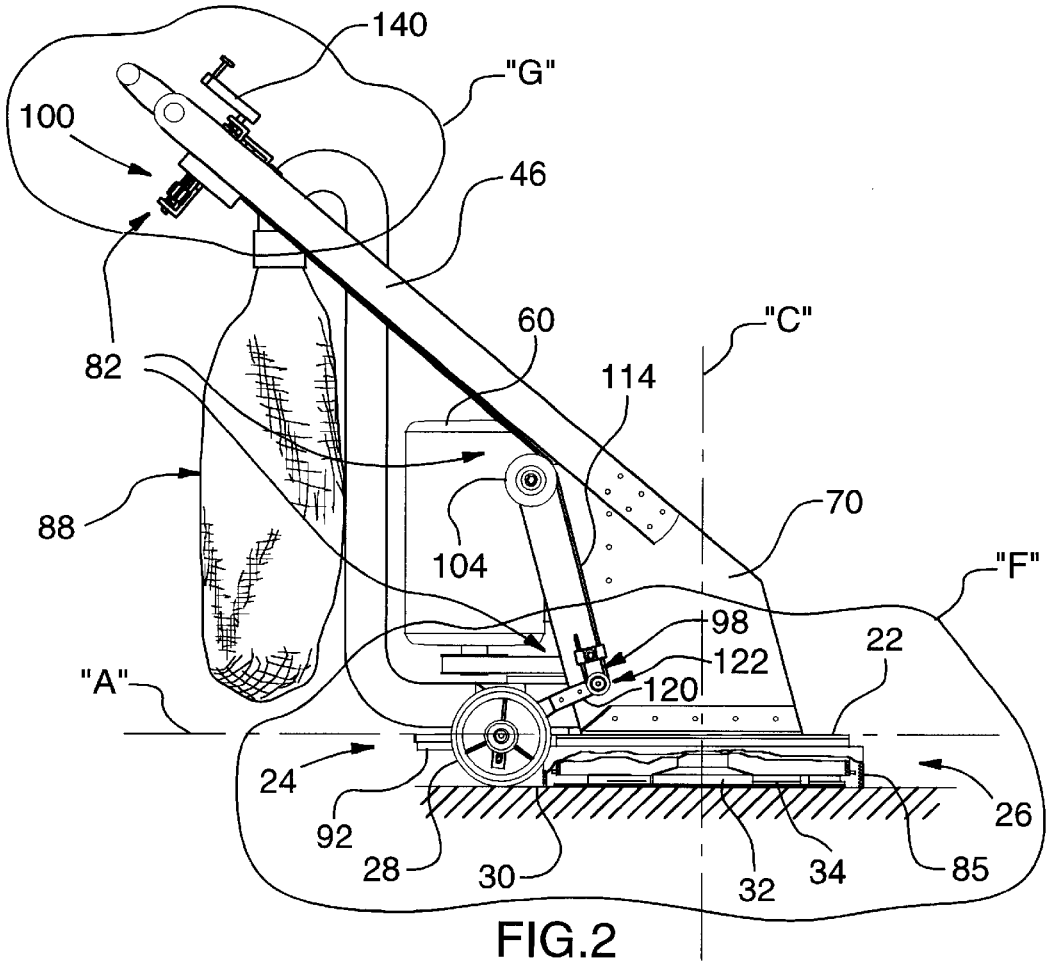
FIG. 2 is a side elevational view of the rotary floor sander of FIG. 1, with a portion of the housing cut away, for clarity.
Figure 3:
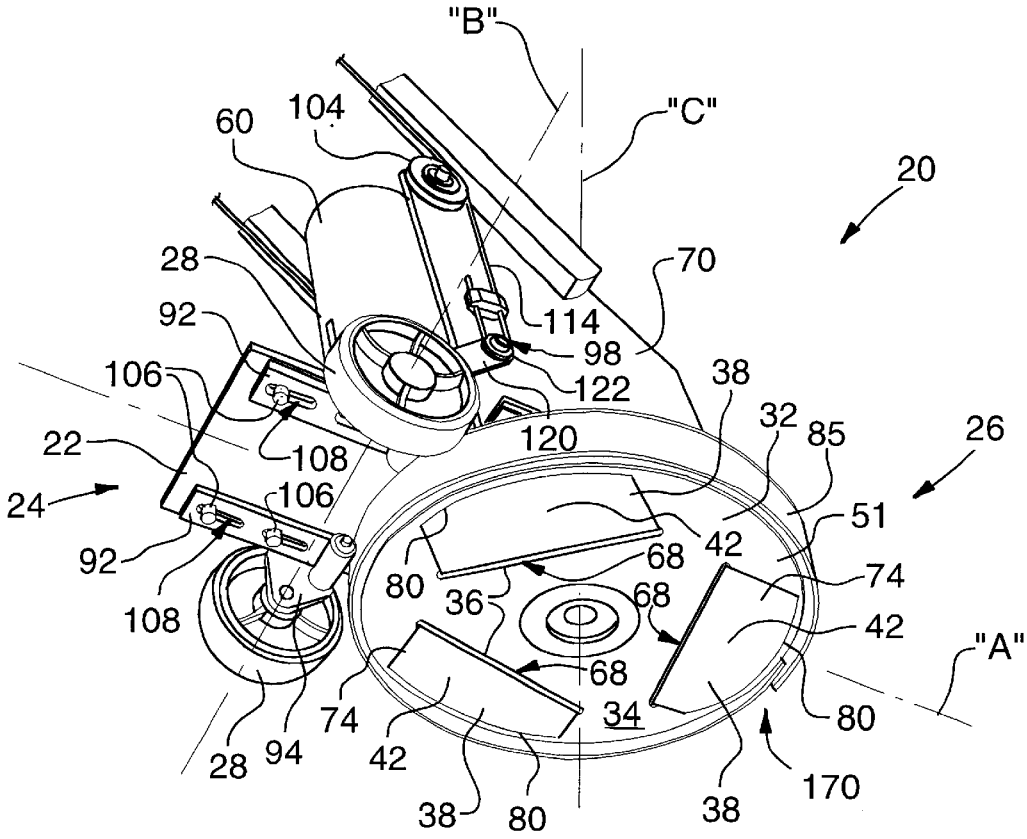
FIG. 3 is a partial bottom perspective view of the rotary floor sander of FIG. 1, with each of the wheels shown at their respective forward positions.

In this regard, and as best illustrated in FIGS. 1 through 3, the machine comprises a platform 22, said platform 22 having a rearward end 24 and a forward end 26 and defining a longitudinal axis "A" extending between said rearward end 24 and said forward end 26. A cover 70 is usefully provided to, inter alia, shield interior components of the machine 20 from dust. A pair of wheels 28 are mounted on the platform 22 adjacent to the rearward end 24 for rotation about a lateral axis "B" extending substantially normal to said longitudinal axis "A". In use, the wheels 28 are operatively positioned upon a floor surface 30 to be finished and support the rearward end 24 of the platform 22 for rolling movement substantially parallel to the longitudinal axis "A". A sanding head member 32, defining a substantially planar sanding face 34, is also provided. The sanding head member 32 is mounted on the platform 22 for rotation about a substantially vertical axis "C" with the sanding face 34 thereof being oriented substantially normal to the substantially vertical axis "C" and substantially parallel to the floor surface 30. Additionally, an attachment means is provided, which is designated by general reference numeral 36 in FIGS. 3 and 4. The attachment means 36 selectively, releasably attaches one or more sheets of flexible sanding media 38, of the type having a smooth side 40 (shown and indicated in FIGS. 12 and 14) and an abrasive side 42, to the sanding head member 32, with the smooth side 40 of each of said sheets 38 in contactable relation to the sanding face 34 and with the abrasive side 42 of each of said sheets 38 in contactable relation to the floor surface 30, as best indicated in FIGS. 3 through 7 and 14. It will be evident to persons skilled in the art that, when the foregoing structure is operatively positioned, rotation of the sanding head member 32 about the substantially vertical axis "C" effects concurrent rotation of the sheets of sanding media 38 and consequent abrasion of the floor surface 30 by the abrasive sides 42 thereof, which rotation in the present invention is provided by a drive means, designated in FIGS. 1 and 15 by general reference numeral 44, which rotates said sanding head member 32 at relatively high speeds, preferably in or about 3000 rpm. The drive means 44 is discussed more fully below. As illustrated in FIGS. 1 and 2, a handle means 46, extending upwardly and rearwardly from the rearward end 24 of the platform, is also provided, for guidance of the machine 20 in operation, and also for transport of the machine 20 when not in operation.

Figure 13:
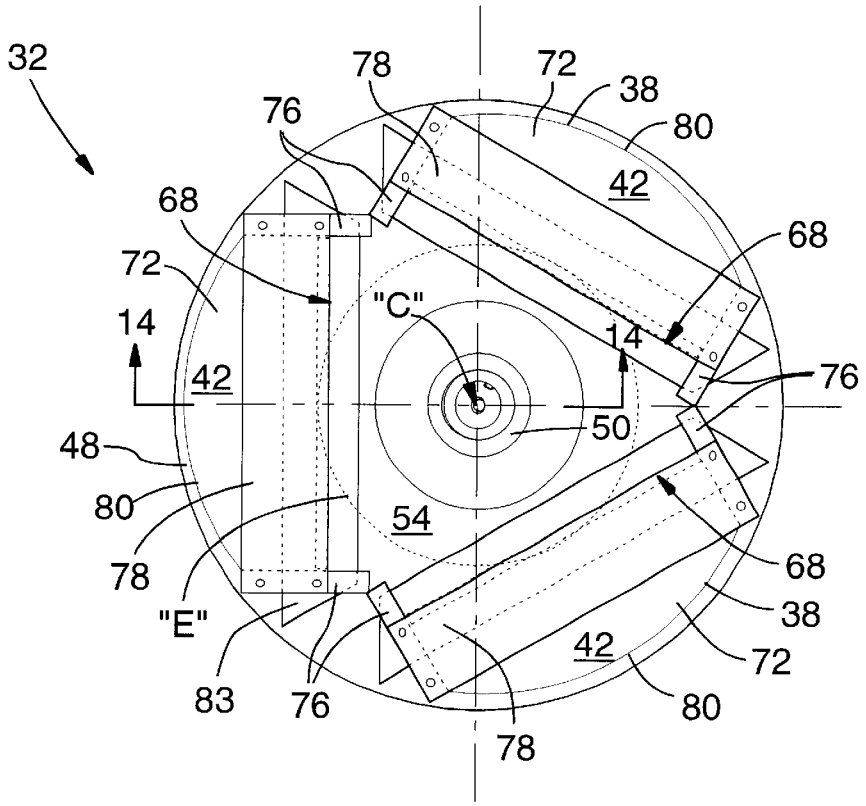
FIG. 13 is a top plan view of the sanding head member of the rotary floor sander of FIG. 1, with sheets of sanding media respectively operatively positioned in each elongate slot.
Figure 14:
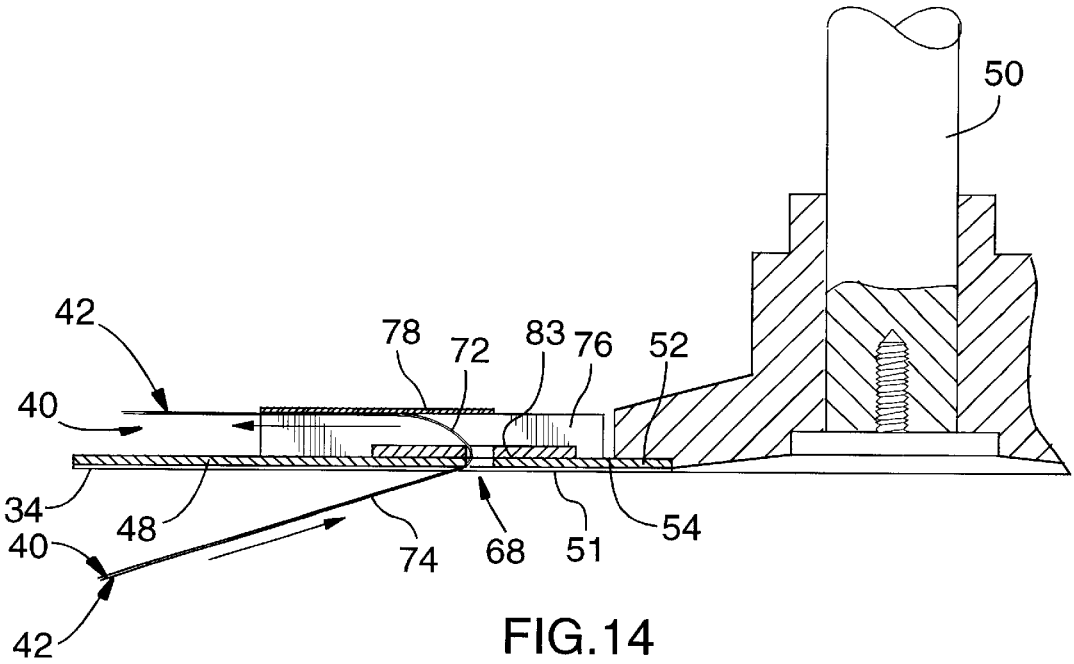
FIG. 14 is a sectional view of the sanding head member of FIG. 13, taken along sight line 14—14 of FIG. 13, illustrating a respective sheet of sanding media operatively positioned in a respective elongate slot.
Figure 15:
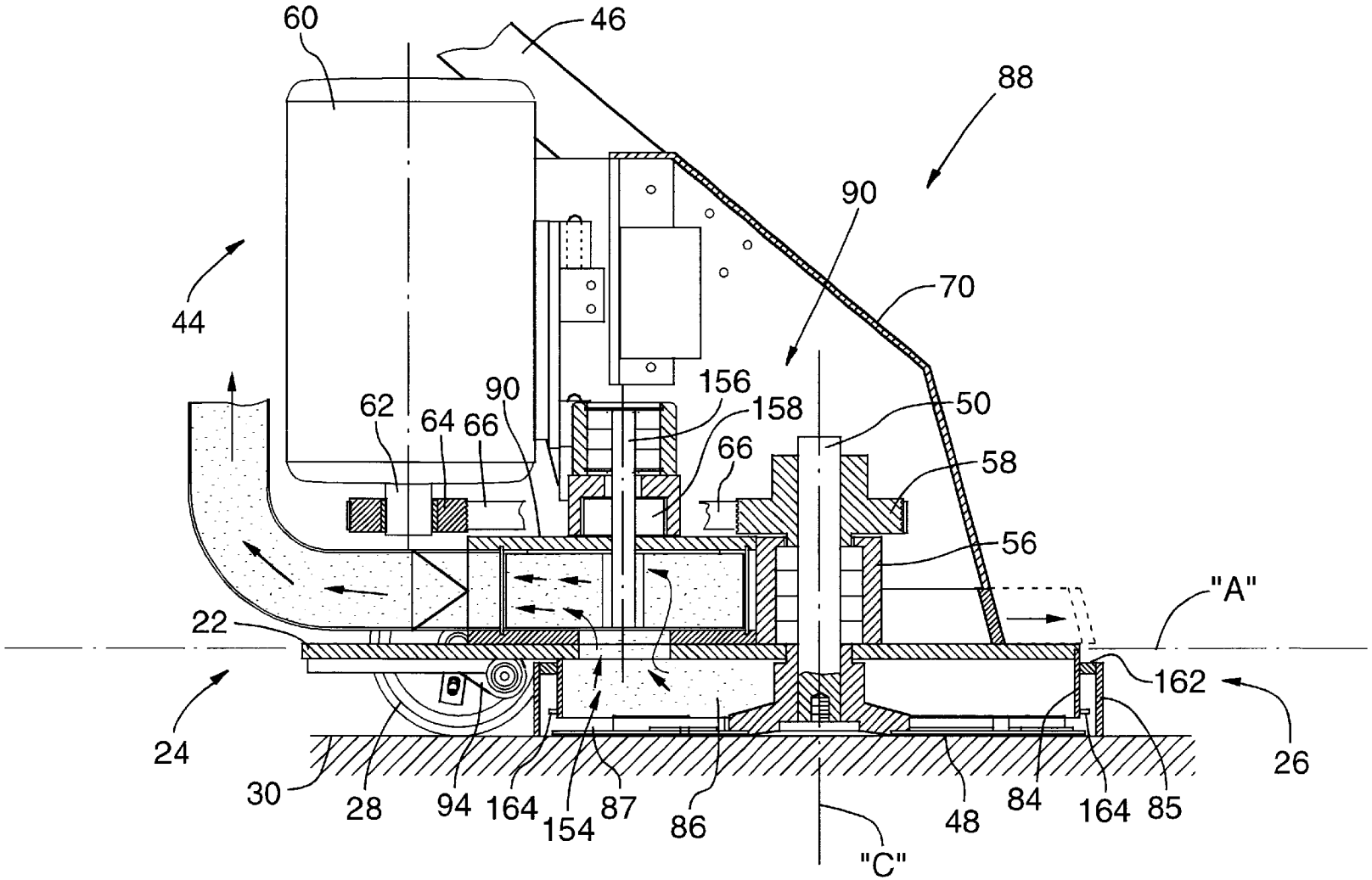
FIG. 15 is a sectional view of the rotary floor sander of FIG. 1, taken along sight-line 15—15 of FIG. 7.

Turning now to the precise manner of construction and operation of the preferred embodiment, it will firstly be appreciated that as a first feature of the preferred embodiment, as best indicated in FIGS. 12 through 15, the sanding head member 32 comprises a substantially planar plate portion 48 of circular plan outline, a felt disc portion 51 of circular plan outline and a first driven shaft portion 50, said first driven shaft portion 50 being substantially centred about the substantially vertical axis "C", rigidly attached to an upper face 54 of the plate portion 48, as best seen in FIG. 14, and operatively received by a thrust bearing 56 mounted on the platform 22, as best seen in FIG. 15. The felt disc portion 51 is affixed to a lower face 52 of the planar plate portion 48 with a lower face 53 of the felt disc portion 51 defining the sanding face 34.

Figure 16:
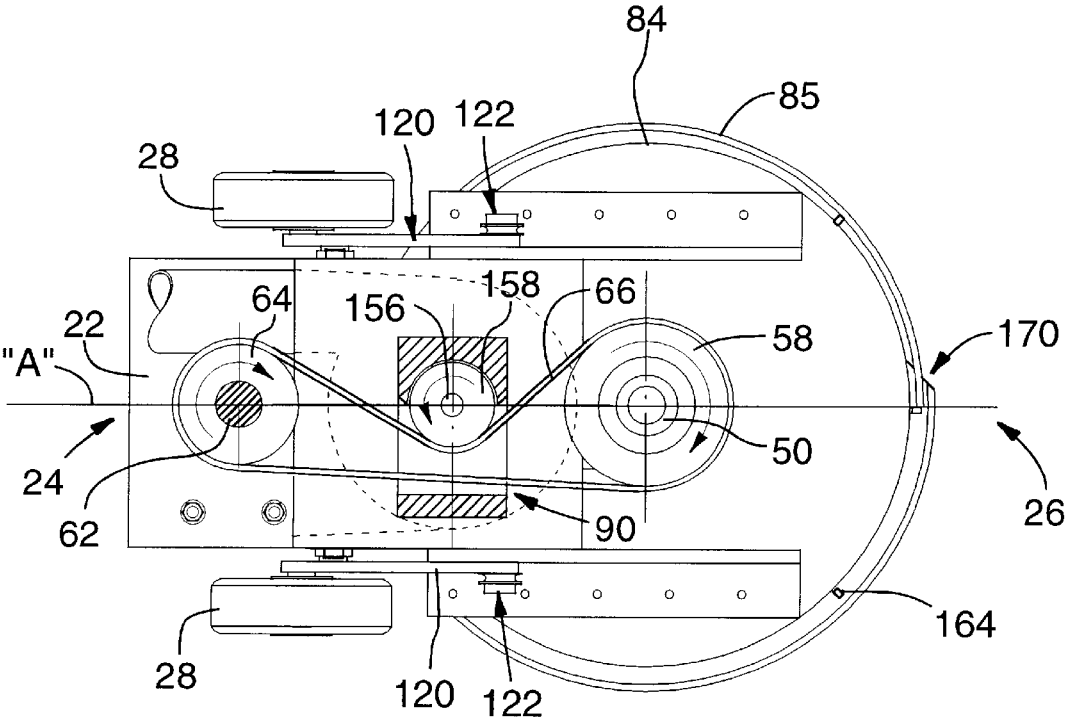
FIG. 16 is a sectional view of the rotary floor sander of FIG. 1, taken along sight-line 16—16 of FIG. 6.

As best seen in FIGS. 1, 15 and 16, in a further feature of the preferred embodiment, the drive means 44 comprises a first pulley 58 operatively connected to said first driven shaft portion 50; a motor 60 rigidly mounted on the platform 22 and having a drive shaft 62; a second pulley 64 operatively connected to said drive shaft 62; and a drive belt 66 extending between and in operative receipt of the first pulley 58 and the second pulley 64.

As yet a further feature of the preferred embodiment, as best indicated in FIGS. 3, 4 and 12 through 14, the attachment means 36 comprises three elongate slots 68 passing substantially vertically through the plate portion 48 and the felt disc portion 51, each slot 68 being aligned substantially tangentially to an arc of rotation "E" defined by the substantially vertical axis "C", as illustrated in FIG. 13. The elongate slots 68 are equally circumferentially spaced from one another, and are each shaped and dimensioned for releasable extension therethrough of a first portion 72 of a respective one of said sheets of flexible sanding media 38, such that, when operatively positioned, the smooth side 40 of a second portion 74 of said sheet 38 is positioned in underlying contactable relation to the sanding face 38, the abrasive side 42 of the second portion 74 is positioned in overlying contactable relation to the floor surface 30 and the first portion 72 of said sheet 38 is positioned in inserted relation to the elongate slot 68.

To assist in retention of said sheets 38 during rotation as aforedescribed, the attachment means 36 further comprises a pair of spacer bars 76 and a rectangular cap plate 78 for each elongate slot 68, the spacer bars 76 being rigidly attached to the upper face 54 of the plate portion 48, adjacent respective ends of said elongate slot 68 and aligned in transverse relation thereto, and the cap plate 78 rigidly extending between each pair of spacer bars 76 in spaced relation to the plate portion 48 and in aligned, overlying relation to the elongate slot 68. The spacer bars 76 and cap plates 78 are shaped and dimensioned such that, when said sheets of sanding media 38 are operatively positioned, the abrasive side 42 of each bears in frictionally retained relation against a respective cap plate 78, as seen in FIG. 14. A reinforcement plate 83 is advantageously positioned in surrounding relation to each elongate slot 68.

It will be evident that the foregoing provides for relatively convenient abrasive exchange in that, when a sheet of abrasive media 38 has become worn, it need simply be removed, and a fresh sheet inserted. Although sheets of sanding media 38 of square plan outline may be utilized (not shown), it is advantageous that each sheet 38 have at least one arcuate edge 80 that roughly corresponds to the circular outline of the plate portion 48 when operatively inserted, to maximize the working abrasive area. Indeed, preferably, the sheets 38 are provided with opposed arcuate edges 80, as shown, inter alia, in FIGS. 3, 12 and 13, such that, when worn, the sheets 38 may be removed, reversed and reinserted.

Figure 4:
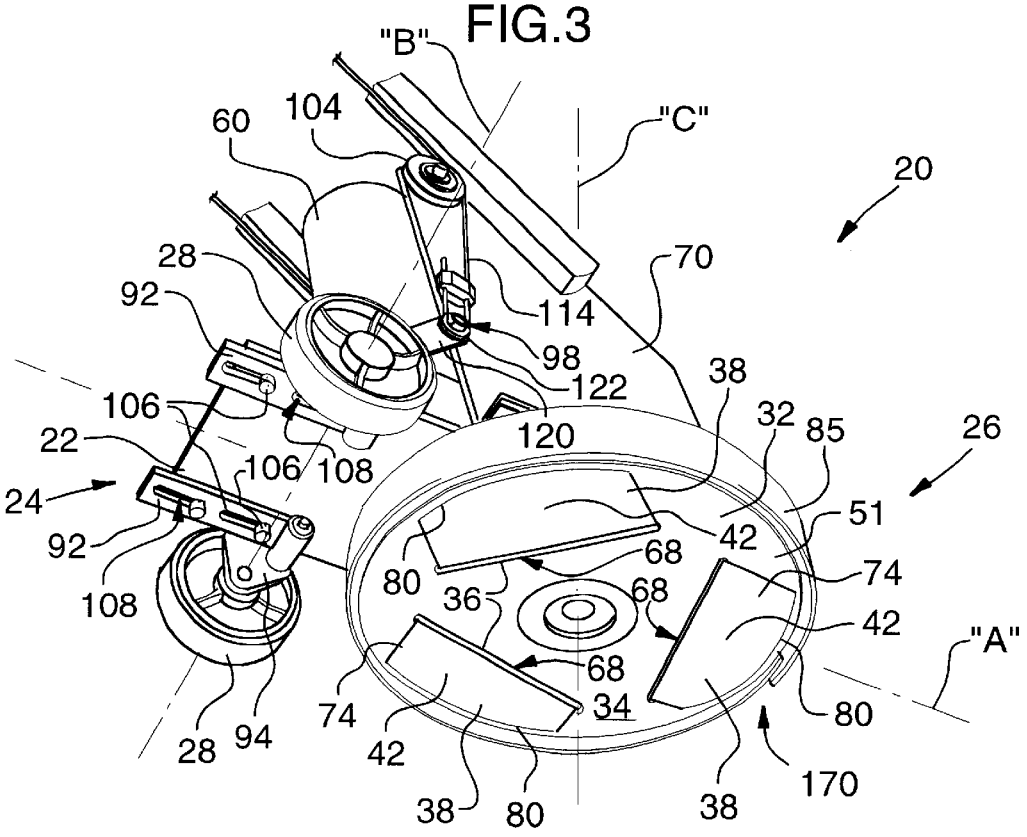
FIG. 4 is view similar to FIG. 3, with each of the wheels shown at their respective rearward positions.
Figure 5:
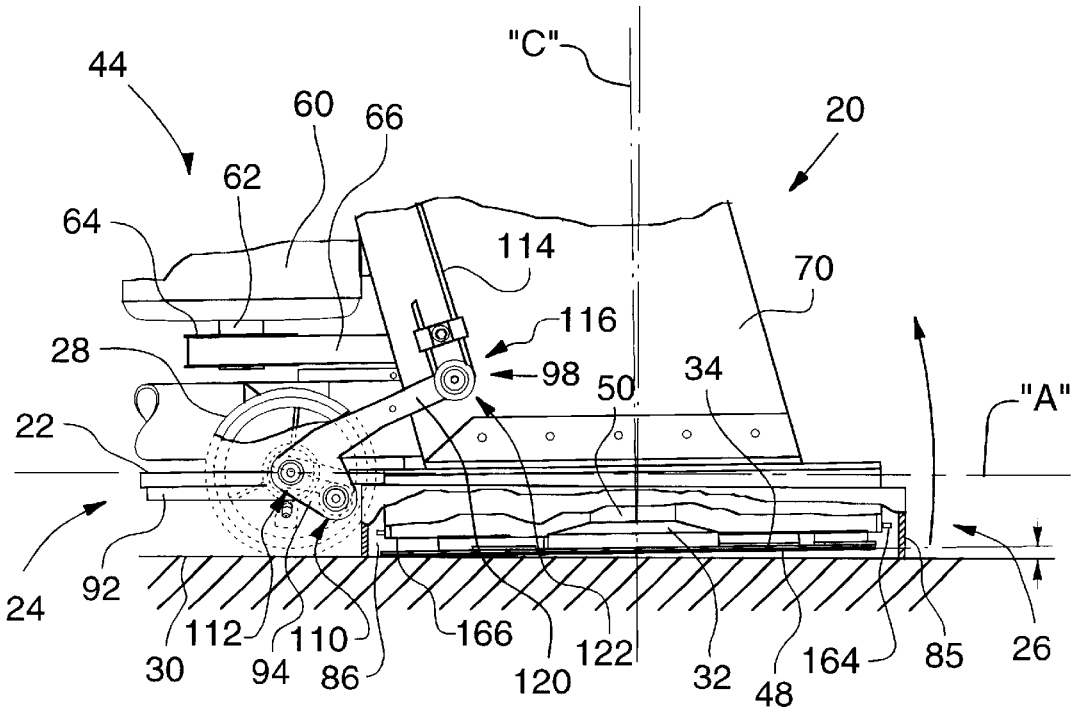
FIG. 5 is an enlarged view of a portion of the rotary sander taken from the circumscribed area "F" of FIG. 2, the right wheel thereof being shown at its fully raised position, with a portion of such wheel being shown in phantom outline.
Figure 6:
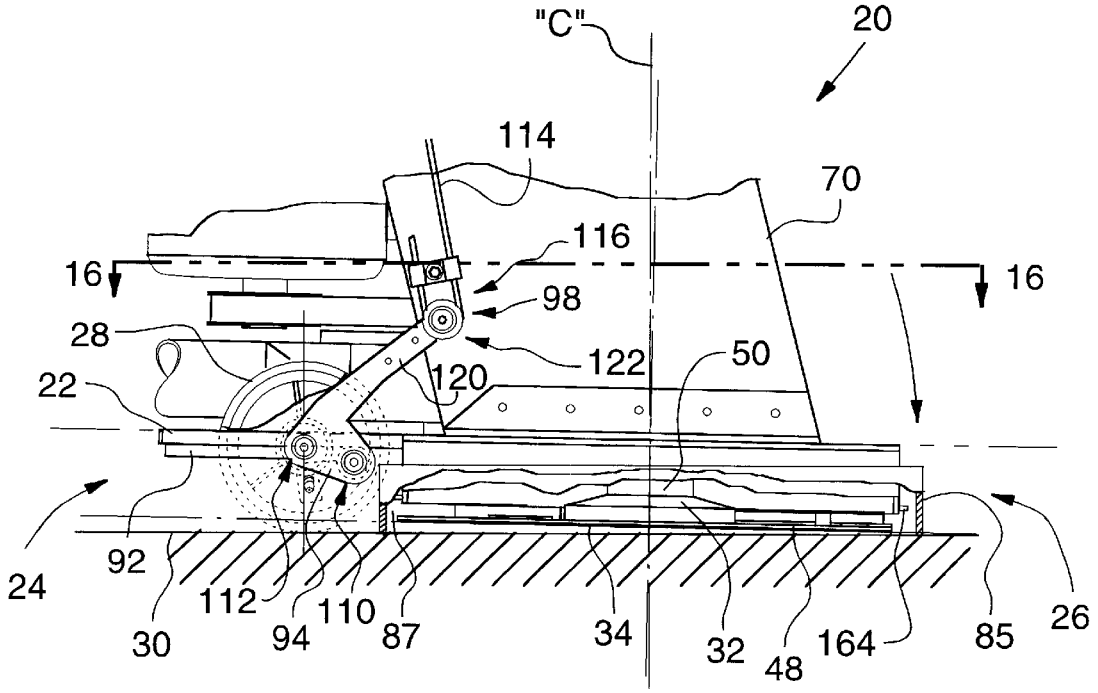
FIG. 6 is a view similar to FIG. 5, with the right wheel thereof being shown at its fully lowered position.

Also provided in the preferred embodiment is a positioning means, designated by general reference numeral 82 in FIG. 2, for selective movement of each of said wheels 28 between a fully raised position, best illustrated in FIG. 5, whereat the rearward end 24 of the platform 22 is relatively proximal to the floor surface 30, and a fully lowered position, substantially downwardly disposed from the fully raised position and best illustrated in FIG. 6, whereat the rearward end 24 of the platform is relatively distal to the floor surface 30. The positioning means 82 also provides for selective movement of each of said wheels 28 between a rearward position, illustrated in FIG. 4, whereat said each wheel 28 is relatively proximal to the rearward end 24 of the platform 22, and a forward position, substantially longitudinally forwardly disposed from the rearward position and illustrated in FIG. 3, whereat said each wheel 28 is relatively distal to the rearward end 24 of the platform 22.

Figure 7:
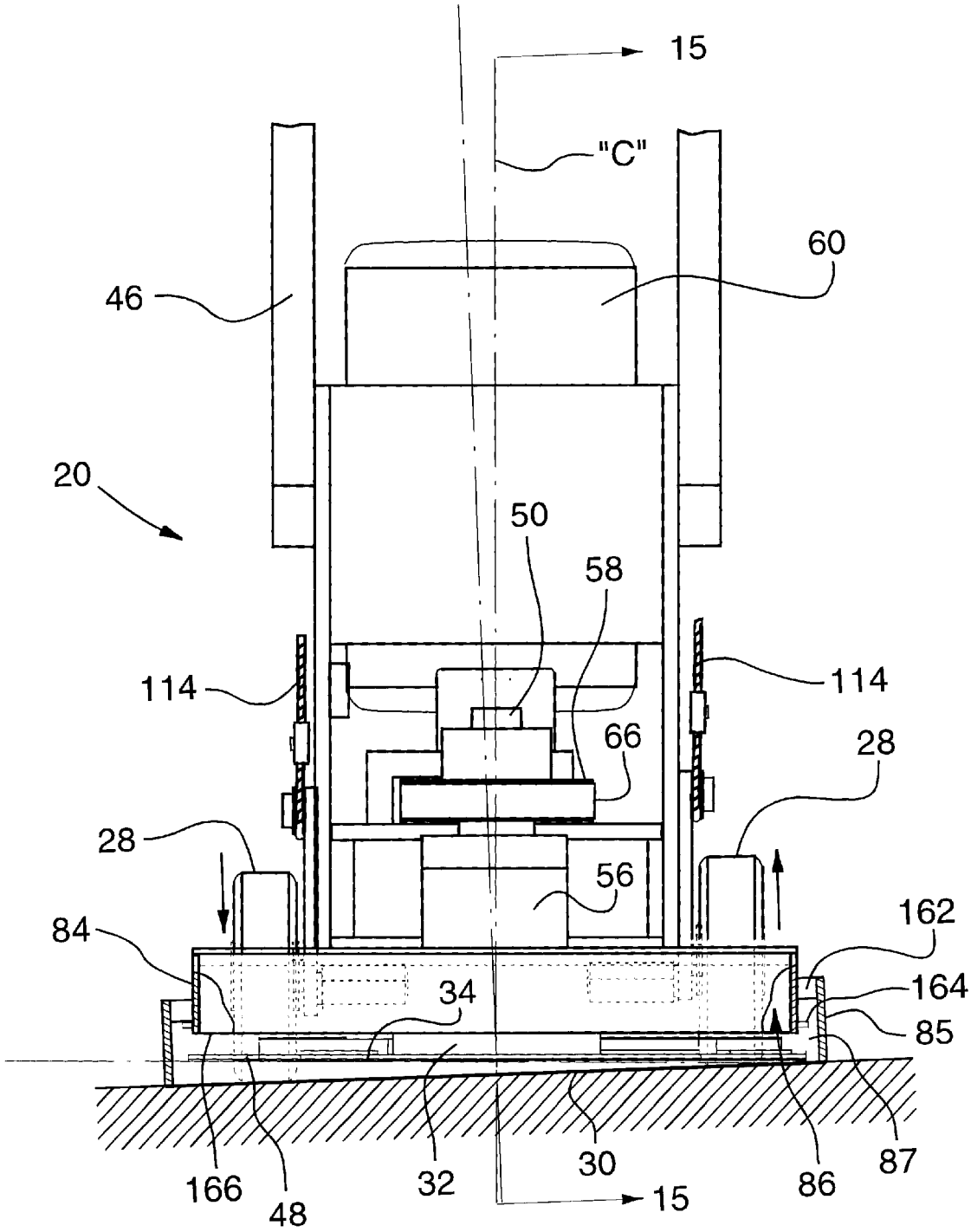
FIG. 7 is a partial front elevational view of the rotary floor sander of FIG. 1, with the left wheel thereof (appearing in the right side of the figure) at its fully raised position, with the right wheel thereof (appearing in the left side of the figure) at its fully lowered position, and the cover removed for clarity.

It will be evident to persons skilled in the art that the adjustment of the positioning means 82 as aforedescribed enables an operator of the sanding machine 20 of the present invention to select an orientation of the plate portion 48 thereof, which ability has been found to have significant utility. For example, movement of the wheel members 28 to their respective lowered positions causes the plate portion 48 to tilt forwardly, as illustrated in FIG. 6, in which configuration, the machine 20 is well-suited for floor sanding operations while travelling longitudinally rearwardly and longitudinally frontwardly. Alternatively, movement of the left wheel member 28 towards its fully raised position and movement of the right wheel member 28 towards its fully lowered position causes the plate portion 48 to tilt downwardly to the left, as illustrated in FIG. 7, in which configuration, the machine 20 is well-suited for floor sanding operations while following an obstruction, such as a wall, located to its left (not shown). It will be appreciated that under both of the above-described operating conditions, the sheets of flexible abrasive media 38 are only in periodic contact with the floor surface 30, and as such, are provided an opportunity to cool during use. This is particularly advantageous in refinishing applications, i.e. wherein an existing coating is required to be removed from the floor surface 30, since the resultant reduction in temperature of the abrasive media 38 renders the coating less prone to melting, which tends to quickly gum the abrasive and render it unusable. In conditions wherein the existing coating is particularly heavy, the wheel members 28 may be moved to their respective rearward positions, as illustrated in FIG. 4, in which configuration, the machine is balanced such that less pressure is exerted by the sheets of abrasive media 38 upon the floor surface 30, thereby to further reduce the working temperature thereof.

Figure 20:
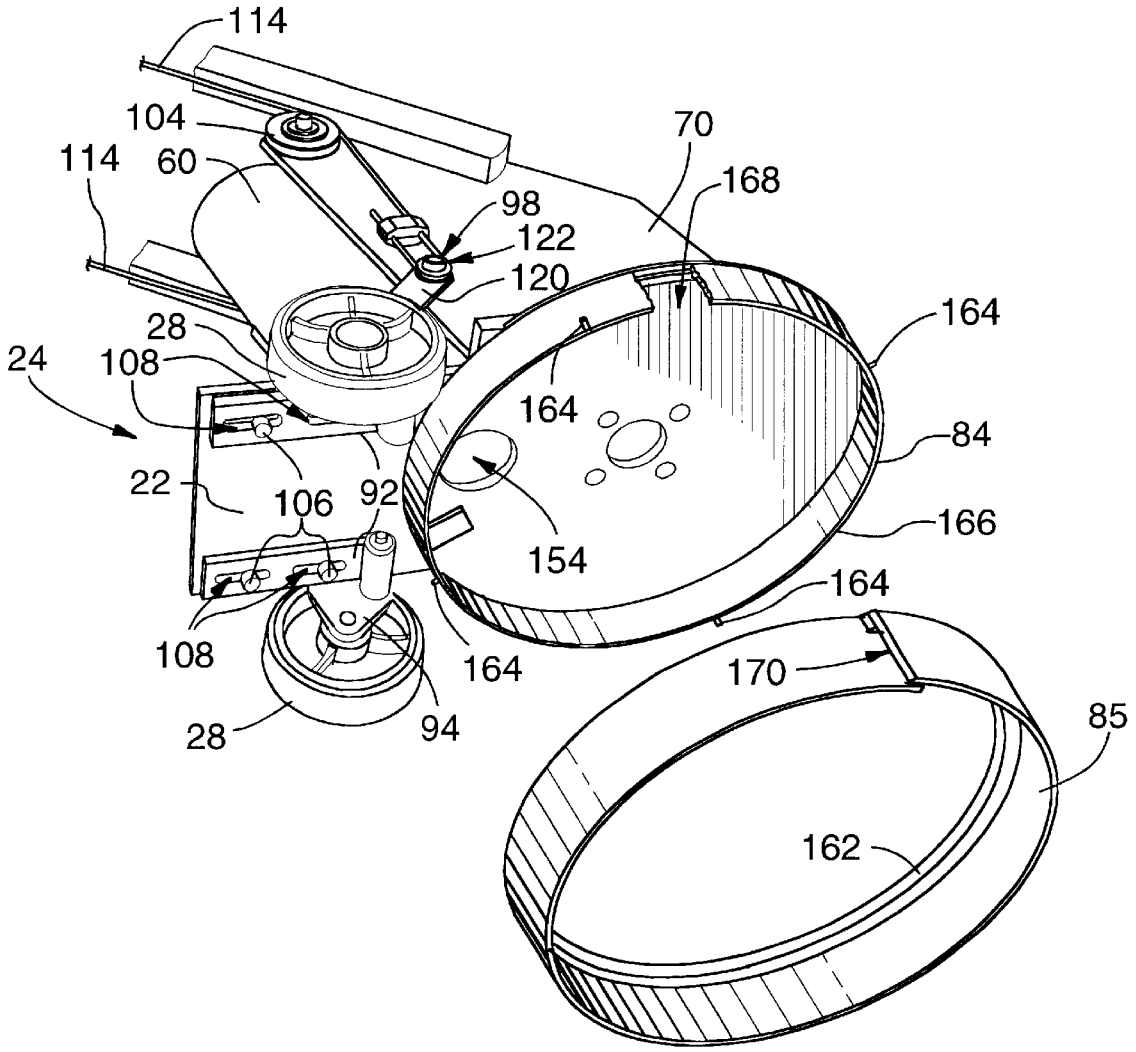
FIG. 20 is a partially exploded perspective view similar to FIG. 3, with the sanding head member removed for clarity.
Figure 21:
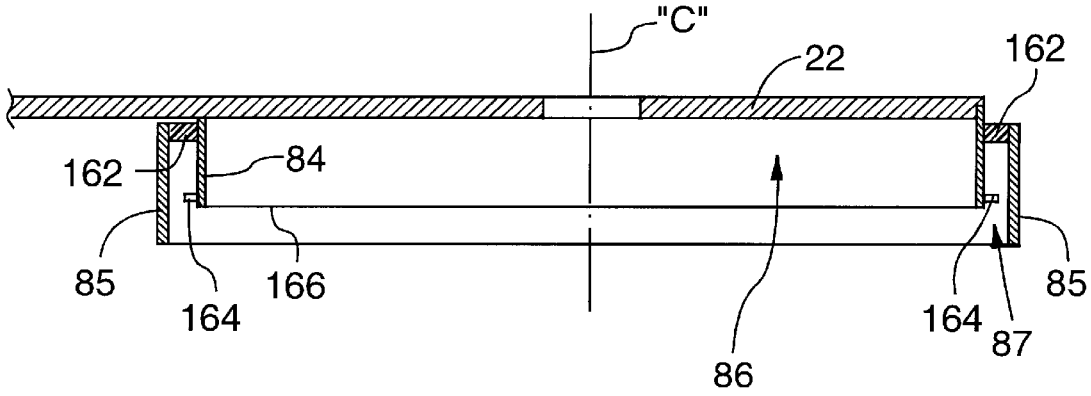
FIG. 21 is a partial sectional view of the rotary floor sander of FIG. 1, along sight-line 21—21 of FIG. 19, showing the skirt member at its raised position.
Figure 22:
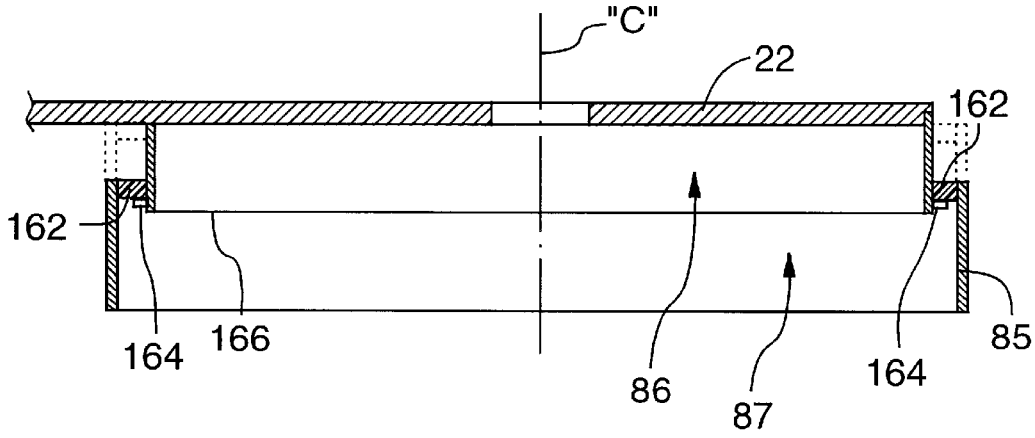
FIG. 22 is a view similar to FIG. 21, showing the skirt member at its lowered position.

As a yet further feature of the preferred embodiment, and as best illustrated in FIGS. 5, 6, and 20 through 22, a downwardly-depending housing member 84 is advantageously provided, mounted on the platform 22 so as to define a substantially downwardly-opening chamber 86, as is a skirt member 85, mounted on the housing member 84 and defining a chamber extension 87 contiguous with said chamber 86, said skirt member 85 being mounted for movement substantially parallel to the substantially vertical axis "C" between a lowered position, illustrated in FIG. 22, whereat the chamber 86 and chamber extension 87 collectively enclose the sanding head member 32 and said one or more sheets of sanding media 38, and a raised position, illustrated in FIG. 21, substantially vertically upwardly disposed from the lowered position. This, coupled with a vacuum means, designated in FIG. 2 with general reference numeral 88 and seen in FIG. 15 to comprise a vacuum impeller 90 in operative fluid communication with the chamber 86, effects the evacuation of dust and other particulate matter generated through abrasion, for the safety and comfort of operators and bystanders. As best illustrated in FIGS. 15, 16 and 20, the vacuum impeller 90 has an inlet 154 operatively opening into the chamber 86 and a second driven shaft 156, said second driven shaft 156 having a third pulley 158 operatively connected thereto, said third pulley 158 being disposed between the first pulley 58 and the second pulley 64 and operatively, drivingly engaged by the drive belt 66.

To achieve the aforedescribed functionality of the skirt member 85, which works to maintain suitable sealing of the skirt member 85 as against the floor surface 30 irrespective of the relative orientation of the platform 22 (resultant from adjustment of the positioning means 82 as aforedescribed), the housing member 84 and skirt member 85 are each substantially cylindrical in shape, the skirt member 85 being fitted in concentric snug-fit relation around the housing member 84. To prevent separation of the skirt member 85 from the housing member 84, an inwardly projecting flange 162 is formed on the skirt member 85 and radially projecting stop pin members 164 are provided adjacent a lower edge 166 of the housing member 84, which flange 162 bears against said stop pin members 164 when said skirt member 85 is at its lowered position, thereby to prevent further downward movement. Respective apertures 168, 170 are additionally formed in the skirt member 85 and the housing member 84, to ensure vacuum draw.

To achieve the contemplated functionality of the positioning means 82, the positioning means 82 of the preferred embodiment, as best seen in FIGS. 1 through 6, generally comprises a pair of subframe members 92, a pair of support arms 94, a cable means 96 having two free ends 98, each operatively pivotally attached to the support arms 94, a differential winching means 100 and a guide means, designated by general reference numeral 102 in FIGS. 1 and 2 and seen to comprise several pulleys 104 operatively mounted to the handle means 46, said pulleys 104 being shaped and dimensioned for, and in guiding receipt of, said cable means 96. The subframe members 92 are laterally spaced from one another, and mounted to the platform 22 by means of bolts 106 which ride in elongate channels 108 formed in said subframe members 92, thereby to facilitate relative selective sliding substantially longitudinal movement of said subframe members 92. The bolts 106, of course, may be tightened to fix the relative position of said subframe members 92. The support arms 94, as best illustrated in FIGS. 3–6, each rigidly extend between a first pivoting portion 110 thereof, which is operatively pivotally attached to a respective one of the subframe members 92, and a second pivoting portion 112 thereof, which is operatively pivotally attached to a respective one of the wheels 28. The differential winching means 100 is operatively attached to the cable means 96 for selective independent withdrawal of the free ends 98 towards said differential winching means 100 and for selective independent extension of the free ends 98 away from said differential winching means 100, with the guide means 102 directing and guiding the cable means 96 such that, upon said selective withdrawal and said selective extension of the free ends 98, each of said wheels 28 is caused to travel between the fully raised position and the fully lowered position thereof.

As illustrated in FIGS. 5, 6, 8 and 9, in the preferred embodiment shown, the cable means 96 comprises two cables 114, each of said cables 114 having a first end 116 and a captive end 118, the first end 116 defining a respective one of the free ends 98 of the cable means 96, and the captive end 118 being operatively rigidly attached to the differential winching means 100. However, it should be appreciated that the cable means 96 could take other forms with equal utility, such as, for example, a single cable (not shown).

Similarly, in the preferred embodiment illustrated, lever arms 120 are also provided, each rigidly extending from the second pivoting portion 112 of a respective support arm 94, in angular relation thereto, to a respective terminus 122 to which is pivotally attached the free end 98 of a respective cable 114, as seen in FIGS. 5 and 6. The provision of lever arms 120 greatly reduces the complexity that would otherwise be required of the guide means 102, but it will be evident that same are not necessary for utility.

Figure 8:
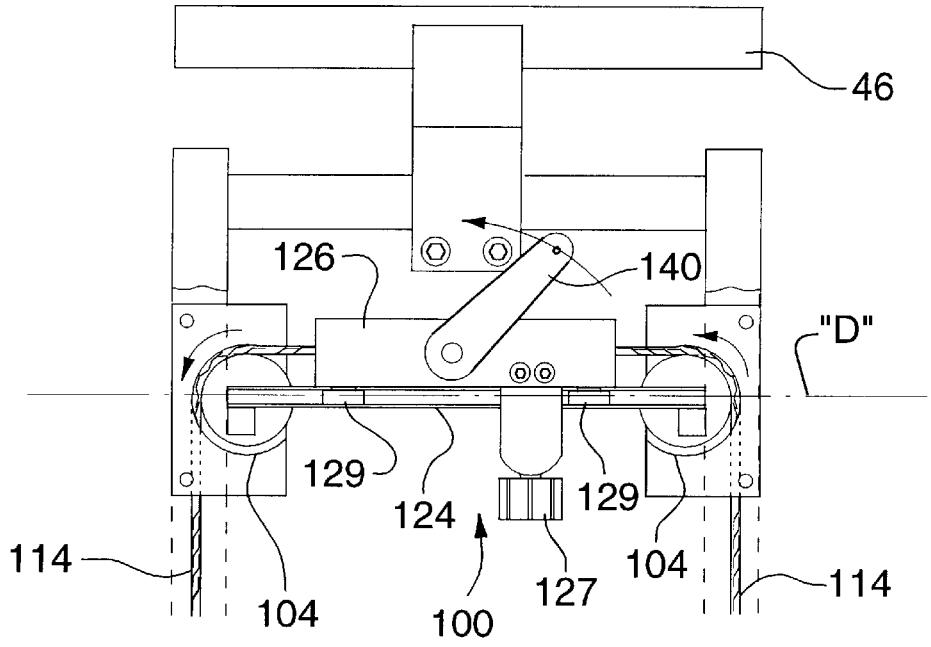
FIG. 8 is a front elevational view of a portion of the rotary floor sander of FIG. 1 taken from the circumscribed area "G" of FIG. 2 showing, inter alia, the winch, the carriage and the rail means.
Figure 9:
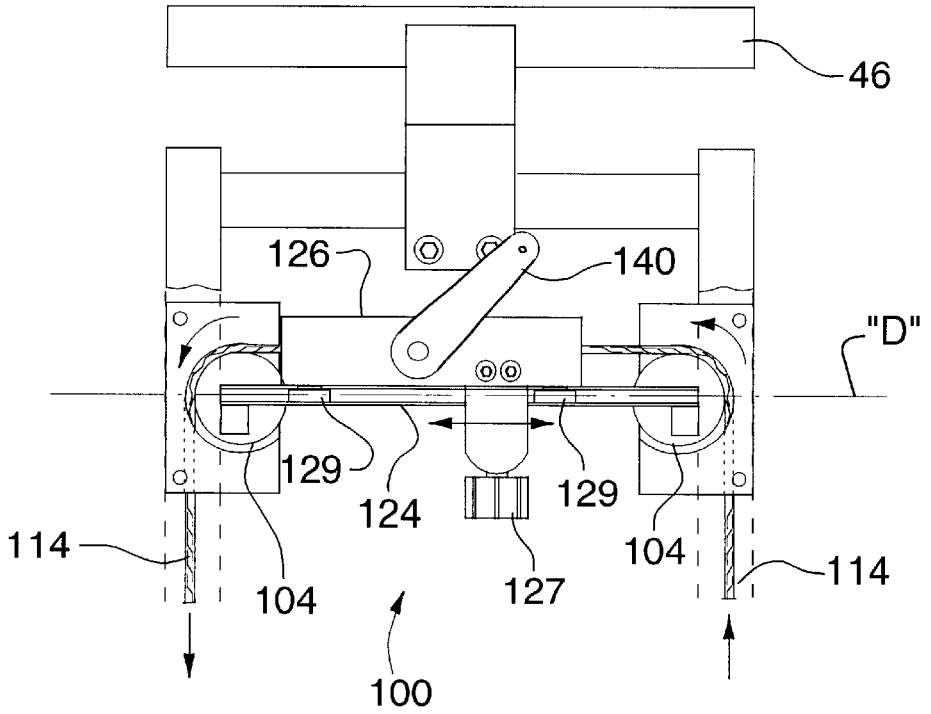
FIG. 9 is a view similar to FIG. 8, showing the winch and the carriage means translated toward the left of the figure along the adjustment axis relative to their respective positions shown in FIG. 8.
Figure 10:
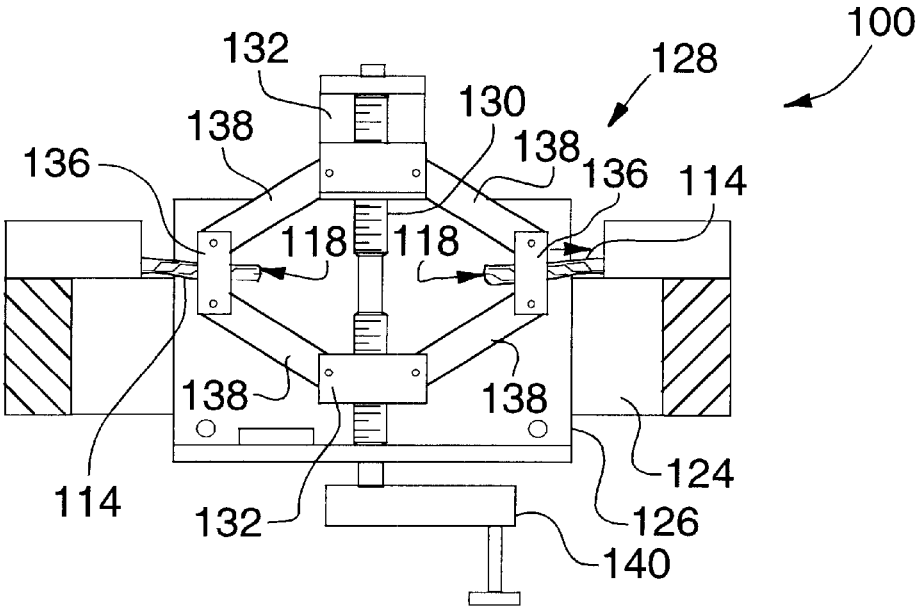
FIG. 10 is a rear elevational view of the winch of FIG. 8.
Figure 11:
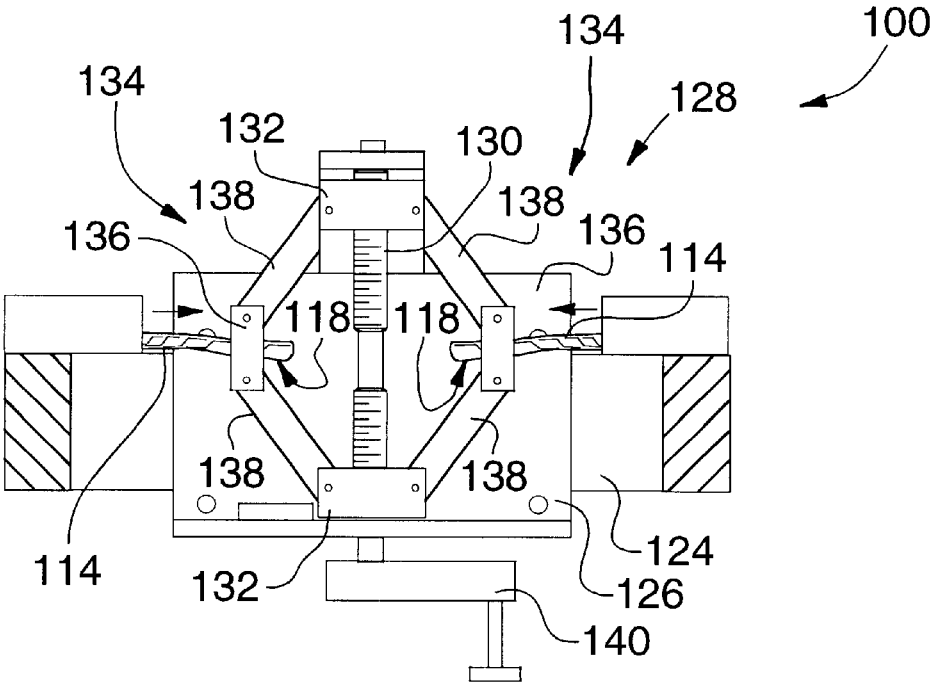
FIG. 11 is a view similar to FIG. 10, with the blocks of the winch drawn together relative to their positions shown in FIG. 10.
Figure 12:
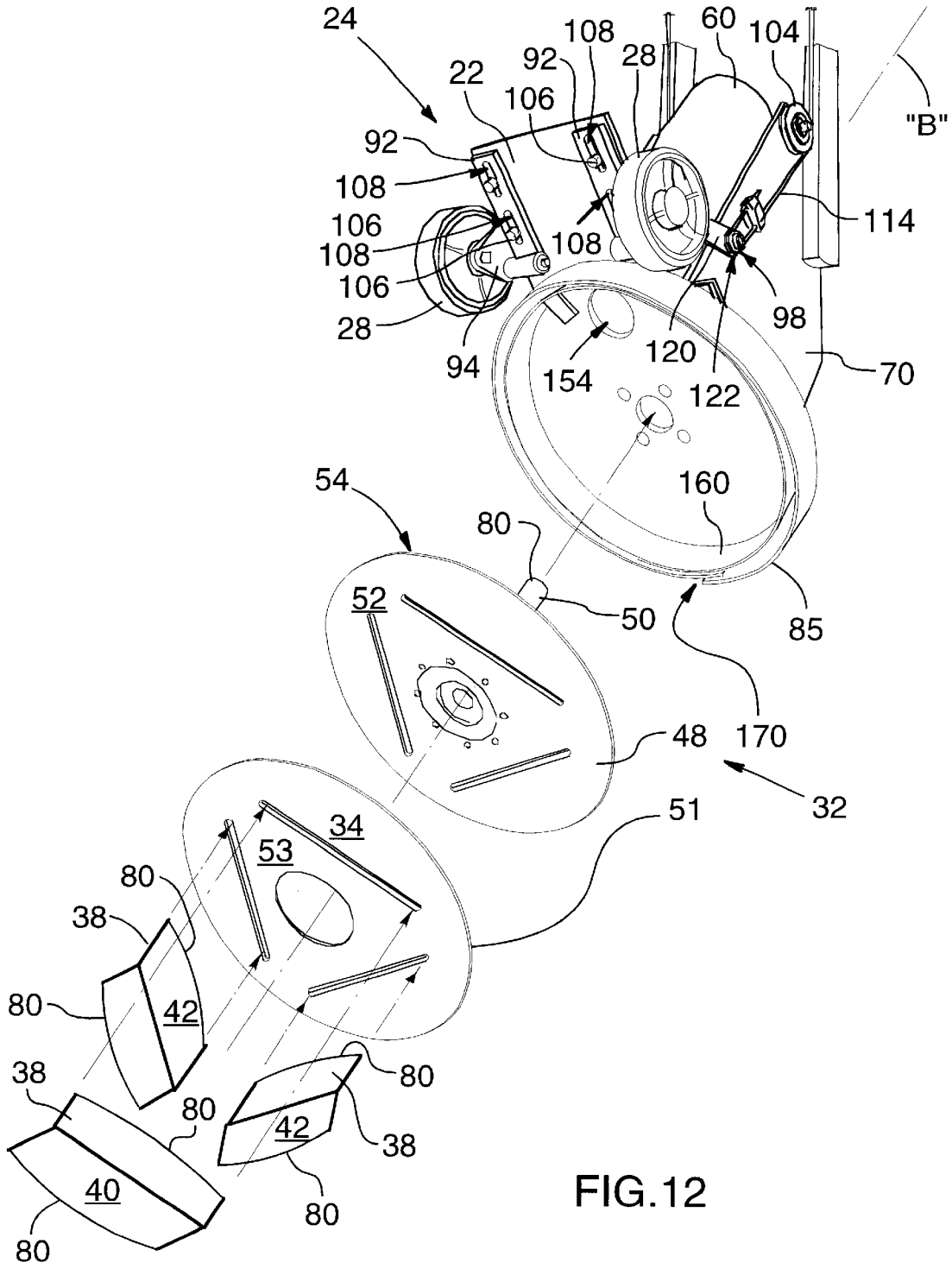
FIG. 12 is an exploded bottom partial perspective view of the rotary floor sander of FIG. 1.

As best illustrated in FIGS. 8 and 9, the differential winching means 100 of the preferred embodiment comprises a rail member 124 rigidly connected to the handle means 46 and defining an adjustment axis "D", with a carriage member 126 mounted for selective translational movement upon said rail member 124 parallel to said adjustment axis "D", and a winch 128 rigidly mounted to said carriage member 126 and operatively connected to the captive end 118 of each cable 114. Wheel members 129 are provided on said carriage member 126 to facilitate said translational movement, as is a set screw member 127, which selectively locks said carriage member 126 as against relative translational movement.

It will be evident that a conventional drum-style winch (not shown) could be employed for the purpose of extending and retracting the cables 114. However, in the preferred embodiment illustrated in FIGS. 10 and 11, the winch 128 is seen to comprise a double-ended bolt 130, a pair of threaded shuttle members 132, respectively positioned adjacent the ends of the double-ended bolt 130 and in operative threaded engagement thereof and two linkage assemblies 134 positioned one each on respective sides of the double ended bolt 130. Each of the linkage assemblies 134 comprises a block 136, rigidly attached to the captive end 118 of a respective one of the cables 114, and a pair of links 138, each of said links 138 being pivotally attached to said block 136 and to a respective one of said threaded shuttle members 132. It will be evident upon rotation of said double-ended bolt 130, the shuttle members 132 will be caused to traverse said bolt 130, whereupon the links 138 will cause the blocks 136 to be drawn together, or distanced from one another, as the case may be, and a handle 140 is accordingly provided, for turning the double-ended bolt 130.

Figure 17:
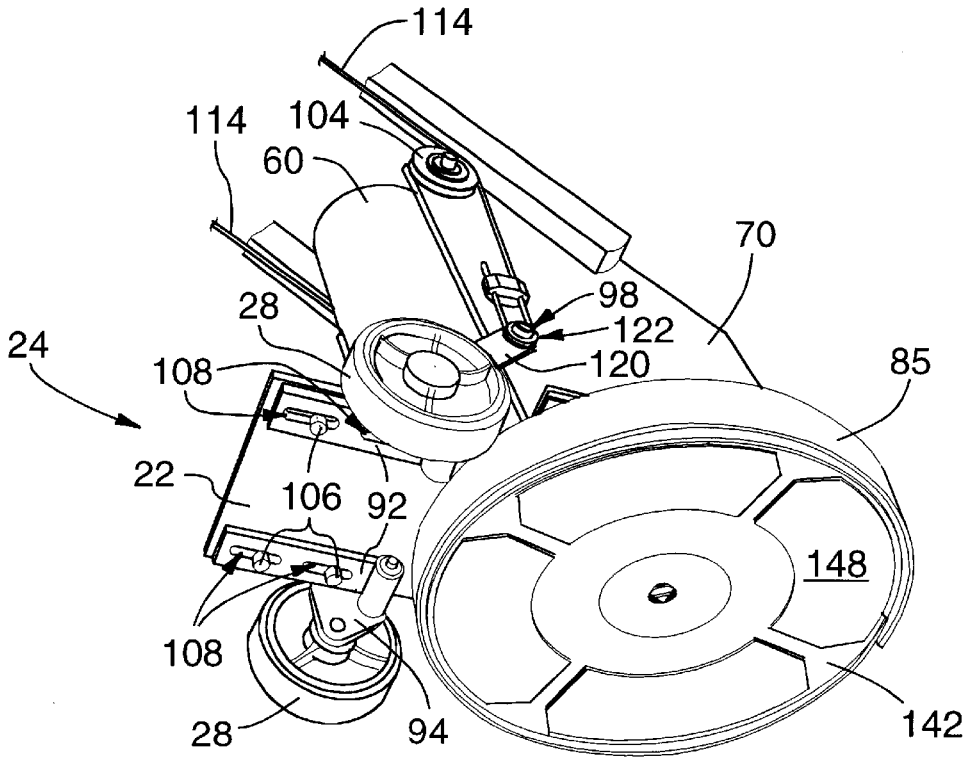
FIG. 17 is a partial bottom perspective view of a rotary floor sander according to an alternative embodiment of the present invention.
Figure 18:
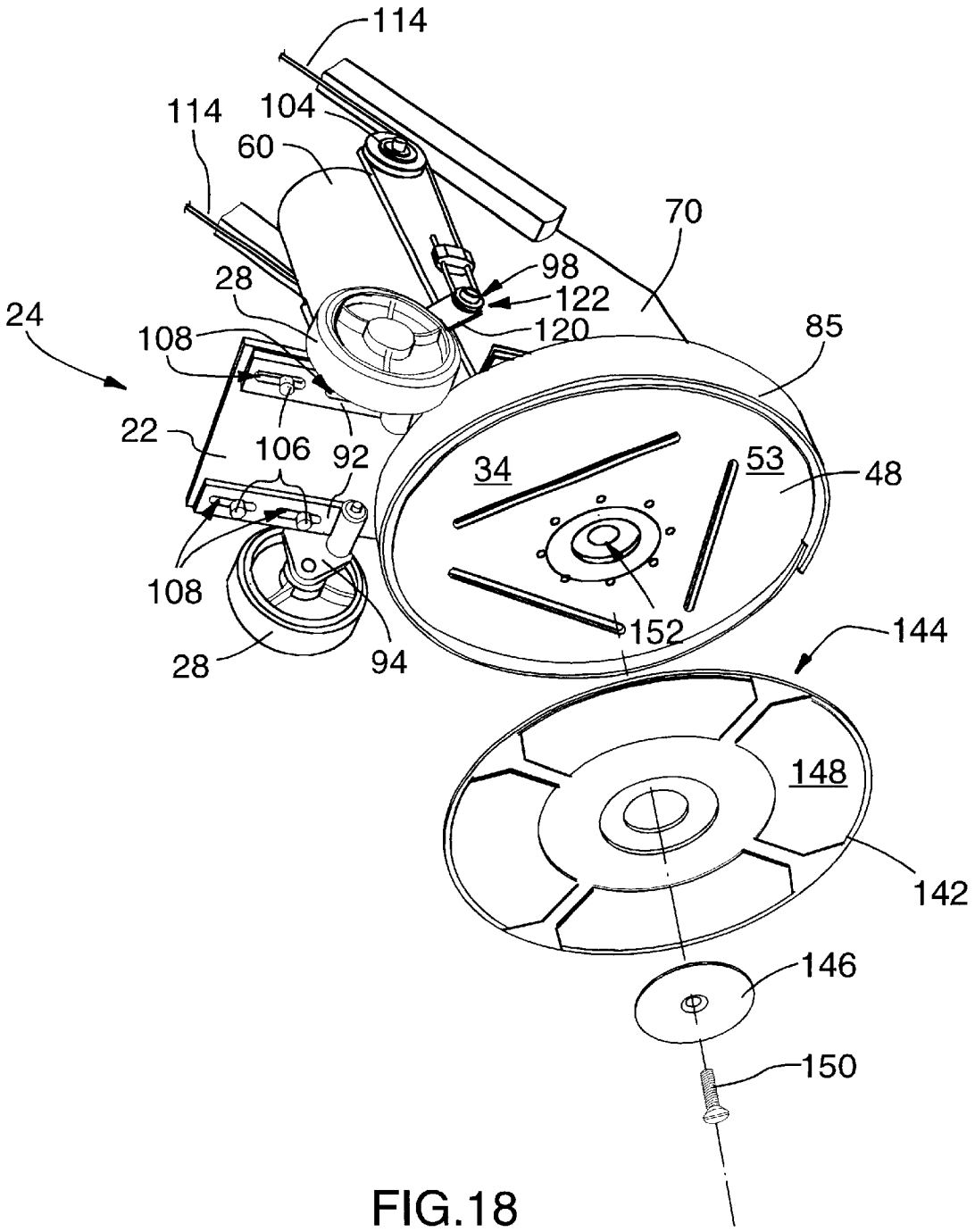
FIG. 18 is an exploded bottom perspective view of the rotary floor sander of FIG. 18.
Figure 19:
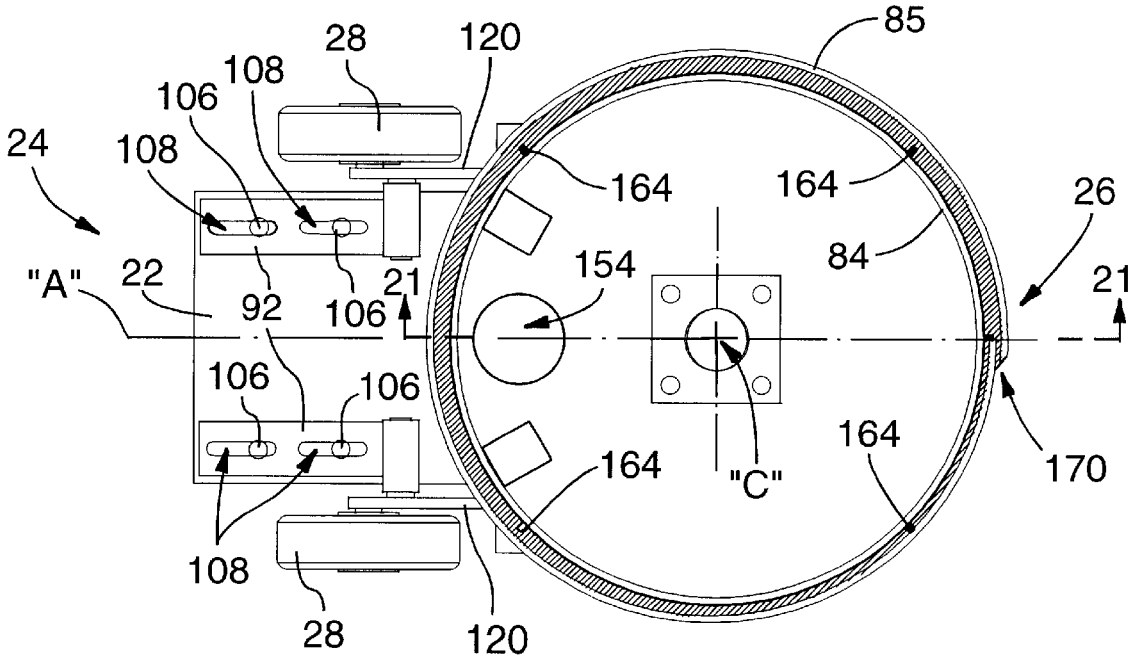
FIG. 19 is a bottom plan view of the rotary floor sander of FIG. 1, with the sanding head member removed for clarity.

As previously outlined, in the preferred embodiment of the present invention, the attachment means 36 comprises, inter alia, elongate slots 68 adapted to receive flexible sheets of sanding media 38. However, it will be appreciated that the teachings of the present invention may be applied in an alternative embodiment of the rotary floor sander, shown in FIGS. 17 and 18, for use with sheets of rigid sanding media in disc form 142. In this embodiment, the sanding face 34 is operatively positioned in abutting contacting relation against a smooth side 144 of the abrasive disc 142, and the attachment means 36 comprises a retaining plate 146 in abutting relation against an abrasive side 148 of the disc 142, which retaining plate 146 is secured in position by means of a bolt 150 operatively threadingly engaged in a threaded bore 152 provided in the plate portion 48.

While but a single preferred embodiment and a single alternative embodiment of the present invention is herein shown and described, it will be evident to persons skilled in the art that other modifications and alterations may be used in the design and manufacture of the rotary floor sander according to the present invention without departing from the spirit and scope of the invention, which is limited only by the accompanying claims.

I claim:

1. A machine for sanding a floor surface for use with one or more sheets of flexible sanding media, each of said sheets having a first portion, a second portion, a smooth side and an abrasive side, said machine comprising:

a platform, said platform having a rearward end and a forward end and defining a longitudinal axis extending between said rearward end and said forward end;

two or more wheels mounted on the platform adjacent said rearward end for rotation about a lateral axis extending substantially normal to said longitudinal axis, said wheels being operatively positioned upon said floor surface so as to support said rearward end of the platform for rolling movement substantially parallel to said longitudinal axis;

a sanding head member defining a substantially planar sanding face, said sanding head member being mounted on the platform for rotation about a substantially vertical axis with said sanding face being oriented substantially normal to said substantially vertical axis and substantially parallel to said floor surface;

a drive means mounted on the platform for driving said rotation of said sanding head member about said substantially vertical axis;

an attachment means for selectively, releasably attaching said one or more sheets of sanding media to said sanding head member for rotation therewith, with the smooth side of each of said sheets in contactable relation to said sanding face and with the abrasive side of each of said sheets in contactable relation to said floor surface;

a handle means rigidly mounted to the platform, adjacent to the rearward end thereof, and oriented substantially upwardly and rearwardly.

2. A machine according to claim 1, further comprising a positioning means for selective movement of each of said wheels between a fully raised position, whereat the rearward end of the platform is relatively proximal to the floor surface, and a fully lowered position, substantially downwardly disposed from the fully raised position, whereat the rearward end of the platform is relatively distal to the floor surface.

3. A machine according to claim 1, further comprising a positioning means for selective movement of each of said wheels between a rearward position, whereat said each wheel is relatively proximal to the rearward end of the platform, and a forward position, substantially longitudinally forwardly disposed from the rearward position, whereat said each wheel is relatively distal to the rearward end of the platform.

4. A machine according to claim 1, further comprising a positioning means for selective movement of each of said wheels between a fully raised position, whereat the rearward end of the platform is relatively proximal to the floor surface, and a fully lowered position, substantially downwardly disposed from the fully raised position, whereat the rearward end of the platform is relatively distal to the floor surface, and for selective movement of each of said wheels between a rearward position, whereat said each wheel is relatively proximal to the rearward end of the platform, and a forward position, substantially longitudinally forwardly disposed from the rearward position, whereat said each wheel is relatively distal to the rearward end of the platform.

5. A machine according to claim 4, wherein the positioning means comprises two or more subframe members, laterally spaced from one another, each of said subframe members being mounted to the platform for selective sliding substantially longitudinal movement relative to said platform.

6. A machine according to claim 5, wherein the positioning means further comprises two or more support arms, each of said support arms having a first pivoting portion thereof and rigidly extending therefrom to a second pivoting portion thereof, each of said support arms being operatively pivotally attached, at the first pivoting portion thereof, to a respective one of the frame members, and at the second pivoting portion thereof, to a respective one of said wheels, thereby to mount said wheels to said platform as aforesaid.

7. A machine according to claim 6, wherein the positioning means further comprises a cable means having two or more free ends, each of said free ends being operatively rigidly attached to a respective one of the support arms.

8. A machine according to claim 7, wherein the positioning means further comprises a guide means for directing and guiding said cable means.

9. A machine according to claim 8, wherein the positioning means further comprises a differential winching means operatively attached to said cable means for selective independent withdrawal of each of said free ends towards said differential winching means through said guide means and for selective independent extension of each of said free ends away from said differential winching means through said guide means.

10. A machine according to claim 9, wherein said guide means guides and directs said cable means such that, upon said selective withdrawal and said selective extension of the free ends of the cable means, each of said wheels travels between the fully raised position and the fully lowered position thereof.

11. A machine according to claim 10, wherein the cable means comprises two or more cables, each of said cables having a first end and a captive end, the first end defining a respective one of the free ends of the cable means.

12. A machine according to claim 11, wherein the positioning means further comprises two or more lever arms, each of said lever arms rigidly extending, from the second pivoting portion of and in angular relation to a respective one of the support arms, to a respective terminus.

13. A machine according to claim 12, wherein each cable has the free end thereof pivotally attached to the terminus of a respective one of the lever arms.

14. A machine according to claim 13, wherein the differential winching means comprises a rail member rigidly connected to the handle means and defining an adjustment axis.

15. A machine according to claim 14, wherein the differential winching means further comprises a carriage member mounted for selective translational movement upon said rail member parallel to said adjustment axis.

16. A machine according to claim 15, wherein the differential winching means further comprises a winch rigidly mounted to said carriage member and operatively connected to the captive end of each cable.

17. A machine according to claim 16, wherein the winch comprises a double-ended bolt.

18. A machine according to claim 17, wherein the winch further comprises a pair of threaded shuttle members, respectively positioned adjacent the ends of the double-ended bolt and in operative threaded engagement thereof.

19. A machine according to claim 18, wherein the winch further comprises two linkage assemblies positioned one each on respective sides of the double ended bolt, each of said linkage assemblies comprising a block, rigidly attached to the captive end of a respective one of the cables, and a pair of links, each of said links being pivotally attached to said block and to a respective one of said threaded shuttle members.

20. A machine according to claim 19, wherein the winch further comprises a handle for turning the double-ended bolt.

21. A machine according to claim 20, wherein the guide means comprises one or more pulleys operatively mounted to said handle means, said pulleys being shaped and dimensioned for, and in guiding receipt of, said cables.

22. A machine according to claim 1, wherein the attachment means comprises one or more elongate slots defined in said sanding face, each of said elongate slots being shaped and dimensioned for releasable extension therethrough of the first portion of a respective one of said sheets of flexible sanding media.

23. A machine according to claim 22, wherein the sanding head member comprises a substantially planar plate portion of circular plan outline and a felt disc portion of circular outline, said felt disc portion being affixed to a lower face of said planar plate portion with a lower face of said felt disc portion defining the sanding face, said elongate slots passing substantially vertically through said plate portion and said felt disc portion.

24. A machine according to claim 23, wherein each elongate slot is aligned substantially tangentially to an arc of rotation defined by the substantially vertical axis.

25. A machine according to claim 24, wherein the attachment means further comprises a plurality of spacer bars rigidly attached in pairs to an upper face of said planar plate portion adjacent respective ends of each elongate slot and aligned in transverse relation thereto.

26. A machine according to claim 25, wherein the attachment means comprises one or more substantially rectangular cap plates, each of said cap plates rigidly extending between a respective pair of spacer bars in aligned, overlying relation to a respective one of said elongate slots.

27. A machine according to claim 26, wherein the spacer bars and cap plates are shaped and dimensioned such that, when said respective one of said sheets of flexible sanding media is operatively positioned, the abrasive side of said first portion bears in frictionally retained relation against the cap plate, the smooth side of the second portion is positioned in underlying contactable relation to said sanding face and the abrasive side of the second portion is positioned in overlying contactable relation to said floor surface.

28. A sanding machine according to claim 23, wherein the sanding head member further comprises a first driven shaft portion substantially centered about said substantially vertical axis and rigidly attached to said plate portion.

29. A machine according to claim 28, further comprising a downwardly-depending housing member mounted on the platform and defining a downwardly-opening chamber.

30. A machine according to claim 29, further comprising a skirt member mounted on the housing member and defining a chamber extension contiguous with said chamber, said skirt member being mounted for movement substantially parallel to the substantially vertical axis between a lowered position, whereat the chamber and chamber extension collectively operatively enclose said sanding head member and said one or more sheets of sanding media, and a raised position, substantially vertically upwardly disposed from the lowered position.

31. A sanding machine according to claim 30, wherein the drive means comprises a first pulley operatively connected to said first driven shaft portion; a motor rigidly mounted on said platform and having a drive shaft; a second pulley operatively connected to said drive shaft; and a drive belt extending between and in operative receipt of each of said first pulley and said second pulley.

32. A machine according to claim 31, further comprising a vacuum means in operative fluid communication with said chamber.

33. A machine according to claim 32, wherein the vacuum means comprises a vacuum cleaner having an inlet operatively opening into said chamber and a second driven shaft, said second driven shaft having a third pulley operatively connected thereto, said third pulley being disposed between said first pulley and said second pulley and operatively, drivingly engaged by said drive belt.

34. A machine for sanding a floor surface for use with one or more sheets of sanding media, each of said sheets having a smooth side and an abrasive side, said machine comprising:

a platform, said platform having a rearward end and a forward end and defining a longitudinal axis extending between said rearward end and said forward end;

two or more wheels mounted on the platform adjacent said rearward end for rotation about a lateral axis extending substantially normal to said longitudinal axis, said wheels being operatively positioned upon said floor surface so as to support said rearward end of the platform for rolling movement thereof substantially parallel to said longitudinal axis;

a sanding head member defining a substantially planar sanding face, said sanding head member being mounted on the platform for rotation about a substantially vertical axis with said sanding face being oriented substantially normal to said substantially vertical axis and substantially parallel to said floor surface;

a drive means mounted on the platform for driving said rotation of said sanding head member about said substantially vertical axis;

an attachment means for selectively, releasably attaching said one or more sheets of sanding media to said sanding head member for rotation therewith, with the smooth side of each of said sheets in underlying contactable relation to said sanding face and with the abrasive side of each of said sheets in contactable relation to said floor surface;

a handle means rigidly mounted to the platform, adjacent to the rearward end thereof, and oriented substantially upwardly and rearwardly.

* * * * *